US007752954B1

(12) United States Patent
Littlefield et al.

(10) Patent No.: US 7,752,954 B1
(45) Date of Patent: Jul. 13, 2010

(54) ELECTROMAGNETIC GUN LAUNCHER

(75) Inventors: Andrew Littlefield, Troy, NY (US); Joshua Root, Watervliet, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/612,165

(22) Filed: Dec. 18, 2006

(51) Int. Cl.
*F41F 1/00* (2006.01)

(52) U.S. Cl. ..... 89/8; 124/3; 42/84

(58) Field of Classification Search ..... 89/8, 89/28.1, 28.05, 135; 124/3; 42/84
See application file for complete search history.

(56) References Cited

U.S. PATENT DOCUMENTS 3,126,789 A * 3/1964 Meyer ..... 89/8
4,677,895 A * 7/1987 Carlson et al. ..... 89/8
4,681,016 A * 7/1987 Creedon ..... 89/8
4,846,911 A * 7/1989 Tackett et al. ..... 156/173
4,858,513 A * 8/1989 Kememy ..... 89/8
4,864,911 A * 9/1989 McKee et al. ..... 89/8
4,884,489 A * 12/1989 Zowarka et al. ..... 89/8
4,961,366 A * 10/1990 Kemeny ..... 89/8
5,076,135 A * 12/1991 Hurn et al. ..... 89/8
5,127,308 A * 7/1992 Thompson et al. ..... 89/8
5,285,763 A * 2/1994 Igenbergs ..... 124/3
5,386,759 A * 2/1995 Onozuka et al. ..... 89/8
5,417,140 A * 5/1995 Onozuka et al. ..... 89/8
5,844,161 A * 12/1998 Meger ..... 89/8
5,856,630 A * 1/1999 Meger ..... 89/8
6,725,759 B1 * 4/2004 Kathe et al. ..... 89/8
2006/0243124 A1 * 11/2006 Jackson et al. ..... 89/1.8

* cited by examiner

*Primary Examiner*—Stephen M Johnson
*Assistant Examiner*—Daniel J Troy
(74) *Attorney, Agent, or Firm*—Michael C. Sachs

(57) ABSTRACT

An electromagnetic launcher having a longitudinal axis includes a pair of longitudinally extending rails; a pair of longitudinally extending insulators disposed between the rails; a bore defined by interior surfaces of the rails and the insulators; and a jacket extending around exterior surfaces of the rails and the insulators; wherein the exterior surfaces of the insulators are substantially flat and further wherein a distance between the exterior surfaces of the insulators is substantially equal to or less than a maximum thickness of the rails.

4 Claims, 4 Drawing Sheets

ELECTROMAGNETIC GUN LAUNCHER

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to electromagnetic guns.

U.S. Pat. No. 4,884,489 issued on Dec. 5, 1989 and U.S. Pat. No. 5,856,630 issued on Jan. 5, 1999 disclose electromagnetic (EM) guns and are incorporated by reference herein. The launcher (barrel) of an EM gun typically comprises a pair of rails separated by a pair of insulators. The interior surfaces of the rails and the insulators form a bore for an armature. During firing of an EM gun, the rails are stressed in a direction away from the bore, while the insulators are usually not stressed. Minimizing rail deflection is an inherent problem in EM guns given that only the rails and not the insulators are loaded during firing. This uneven loading results in the EM launcher cross-section deforming into an elongated oval shape.

Traditionally, EM launchers have relied on prestress to minimize rail deflection. Some methods of obtaining this prestress have included clamped steel laminates, pressure cured epoxy laminates, hydraulically prestressed composites and bolted prestressed steel laminates. In a prestressed design, the load on the rails pushes against the applied prestress in addition to pushing against the stiffness of the materials, therefore lessening the deflection of the rails.

The methods for achieving the prestress are not easy to implement. The methods often result in very heavy guns suitable only for laboratory use. Additionally, for guns not confined to a laboratory setting, insulators with good compression strength are required to achieve the desired prestress levels. This normally resulted in large insulators and an overall oval design for the launcher. The oval design, by itself, results in extra rail deflection because as the jacket is loaded it flattens itself out by compressing the insulators towards the bore.

SUMMARY OF THE INVENTION

It is an object of the invention to provide an EM gun with a minimum of rail deflection.

It is another object of the invention to provide an EM gun that does not need prestress.

It is a further object of the invention to provide an EM gun that is lighter in weight than known EM guns.

One aspect of the invention is an electromagnetic launcher having a longitudinal axis and comprising a pair of longitudinally extending rails; a pair of longitudinally extending insulators disposed between the rails; a bore defined by interior surfaces of the rails and the insulators; and a jacket extending around exterior surfaces of the rails and the insulators; wherein the exterior surfaces of the insulators are substantially flat and further wherein a distance between the exterior surfaces of the insulators is substantially equal to or less than a maximum thickness of the rails.

In one embodiment, a modulus of elasticity of the jacket is at least $20\times10^6$ psi. The interior surfaces of the jacket preferably include: 1) substantially flat surfaces that mate with the exterior surfaces of the insulators; and 2) curved surfaces that mate with the exterior surfaces of the rails.

In a preferred embodiment, the exterior surfaces of the rails are substantially semi-circular. The diameters of the substantially semi-circular exterior surfaces of the rails are substantially equal to the maximum thickness of the rails.

Another aspect of the invention is an electromagnetic launcher having a longitudinal axis and comprising a pair of longitudinally extending rails; a jacket extending around exterior surfaces of the rails; and a bore defined by interior surfaces of the rails and the jacket; wherein portions of the interior surface of the jacket that define the bore are substantially flat and further wherein a difference between a distance between the substantially flat portions of the interior surface of the jacket and a maximum thickness of the rails is a minimum distance that ensures a projectile does not contact the jacket.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
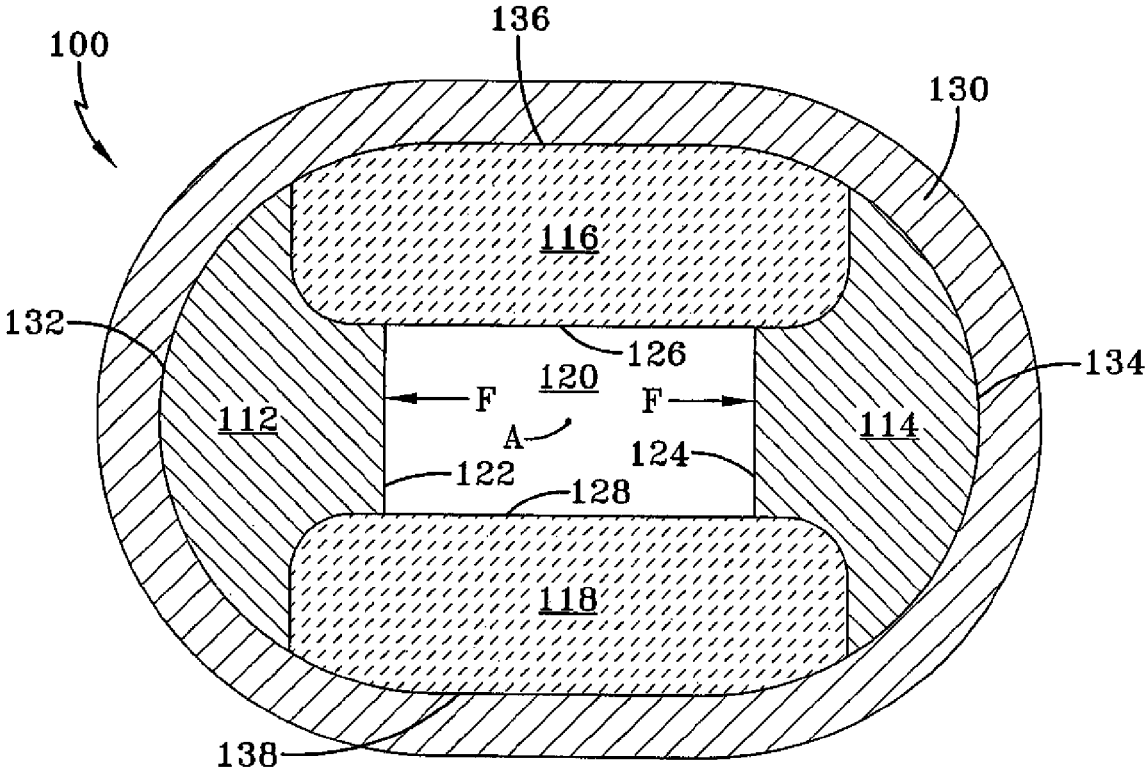
FIG-1 PRIOR ART
FIG. 1 is a transverse cross-section of a prior launcher.

FIG. 1 is a transverse cross-section of a prior launcher 100. Launcher 100 has a longitudinal axis A that is perpendicular to the plane of FIG. 1; a pair of longitudinally extending rails 112, 114; a pair of longitudinally extending insulators 116, 118 disposed between the rails 112, 114; a bore 120 defined by interior surfaces 122, 124, 126, 128 of the rails 112, 114 and the insulators 116, 118, respectively; and a jacket 130 extending around exterior surfaces 132, 134, 136, 138 of the rails 112, 114 and the insulators 116, 118, respectively. The jacket 130 is generally constructed to preload or prestress the rails 112, 114 and insulators 116, 118.

During operation, the electromagnetic forces that propel the projectile also tend to push the rails 112, 114 apart, as shown by the arrows F in FIG. 1. This in turn causes compressive forces on the external surfaces 136, 138 of the insulators 116, 118. The combination of forces causes distortion of the bore 120. If the rails 112, 114 are pushed apart, the armature will lose electrical contact, thereby reducing the effectiveness of the launcher 100.

Figure 2:
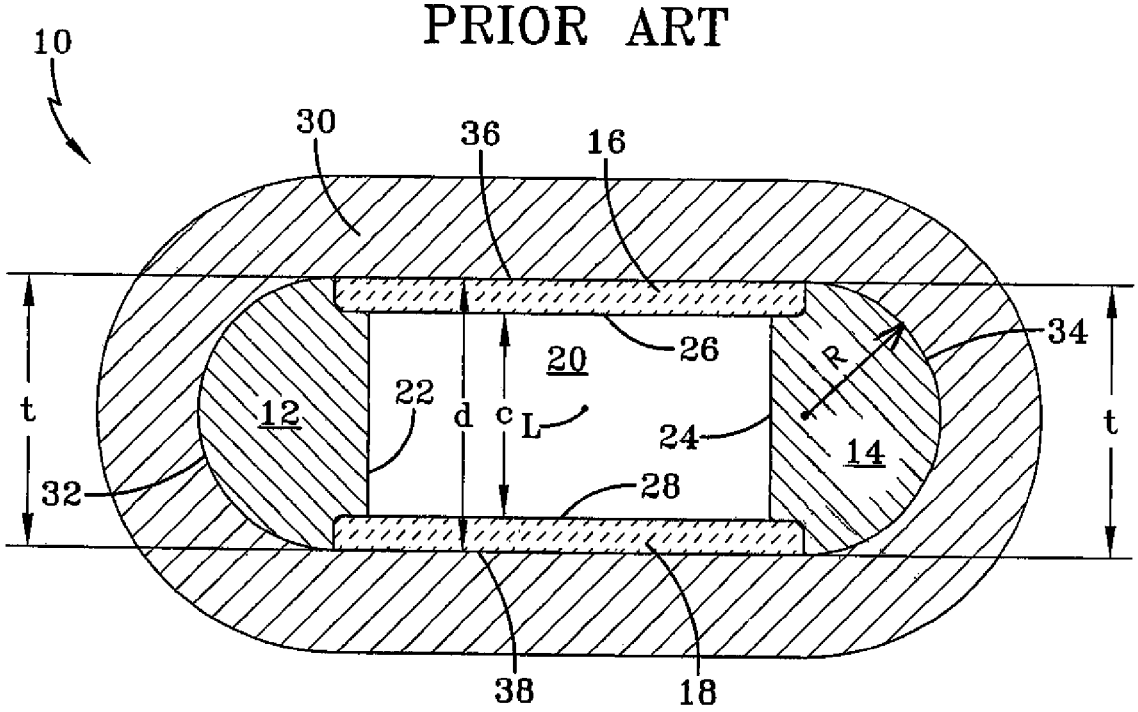
FIG. 2 is a transverse cross-section of one embodiment of a launcher in accordance with the invention.

FIG. 2 is a transverse cross-section of one embodiment of a launcher 10 in accordance with the invention. Launcher 10 has a longitudinal axis L that is perpendicular to the plane of FIG. 2; a pair of longitudinally extending rails 12, 14; a pair of longitudinally extending insulators 16, 18 disposed between the rails 12, 14; a bore 20 defined by interior surfaces 22, 24, 26, 28 of the rails 12, 14 and the insulators 16, 18, respectively; and a jacket 30 extending around exterior surfaces 32, 34, 36, 38 of the rails 12, 14 and the insulators 16, 18, respectively. The exterior surfaces 36, 38 of the insulators 16, 18 are substantially planar (flat). A distance d between the exterior surfaces 36, 38 of the insulators 16, 18 is substantially equal to or less than a maximum thickness t of the rails 12, 14. An exemplary size of bore 20 is three inches by an inch and a half.

Launcher 10 relies in part on geometric considerations rather than prestress to minimize deflection of the rails 12, 14. The stiffness of jacket 30, rather than prestress, mitigates the deflection of rails 12, 14. By flattening out the traditional oval shape (FIG. 1) on the insulator exterior surfaces 36, 38, the jacket 30 is placed in tension quickly and cannot elongate simply by flattening itself out, as in traditional designs. Additionally, the distance d between the external surfaces 36, 38 of the insulators 16, 18 is substantially equal to or less than the maximum thickness t of the rails 12, 14 so that any flattening loads are resisted by the rails 12, 14 and not by the insulators 16, 18.

Figure 4:
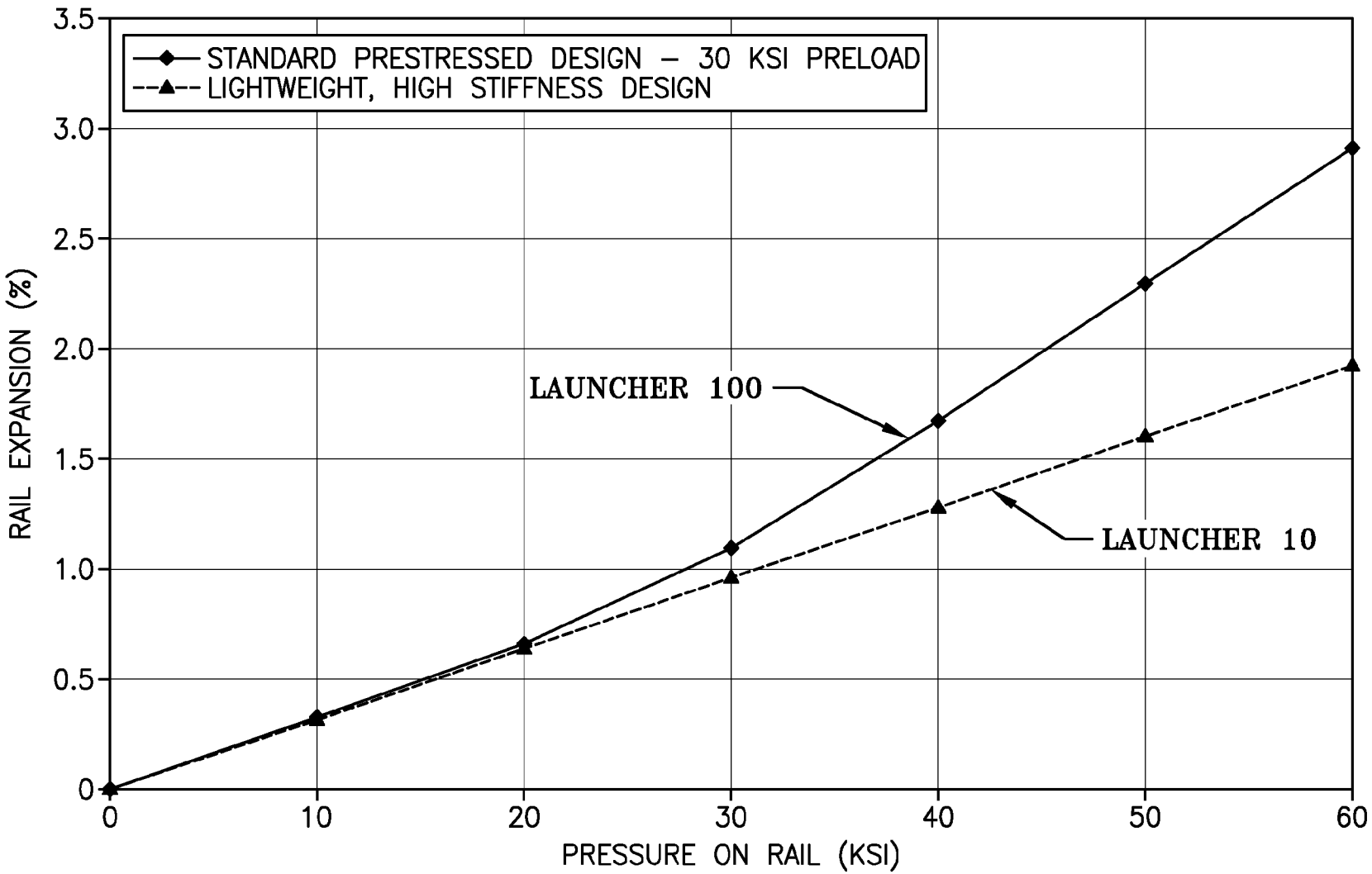
FIGS. 4 and 5 graphically compare the rail expansion of prior launchers to the invention.
Figure 5:
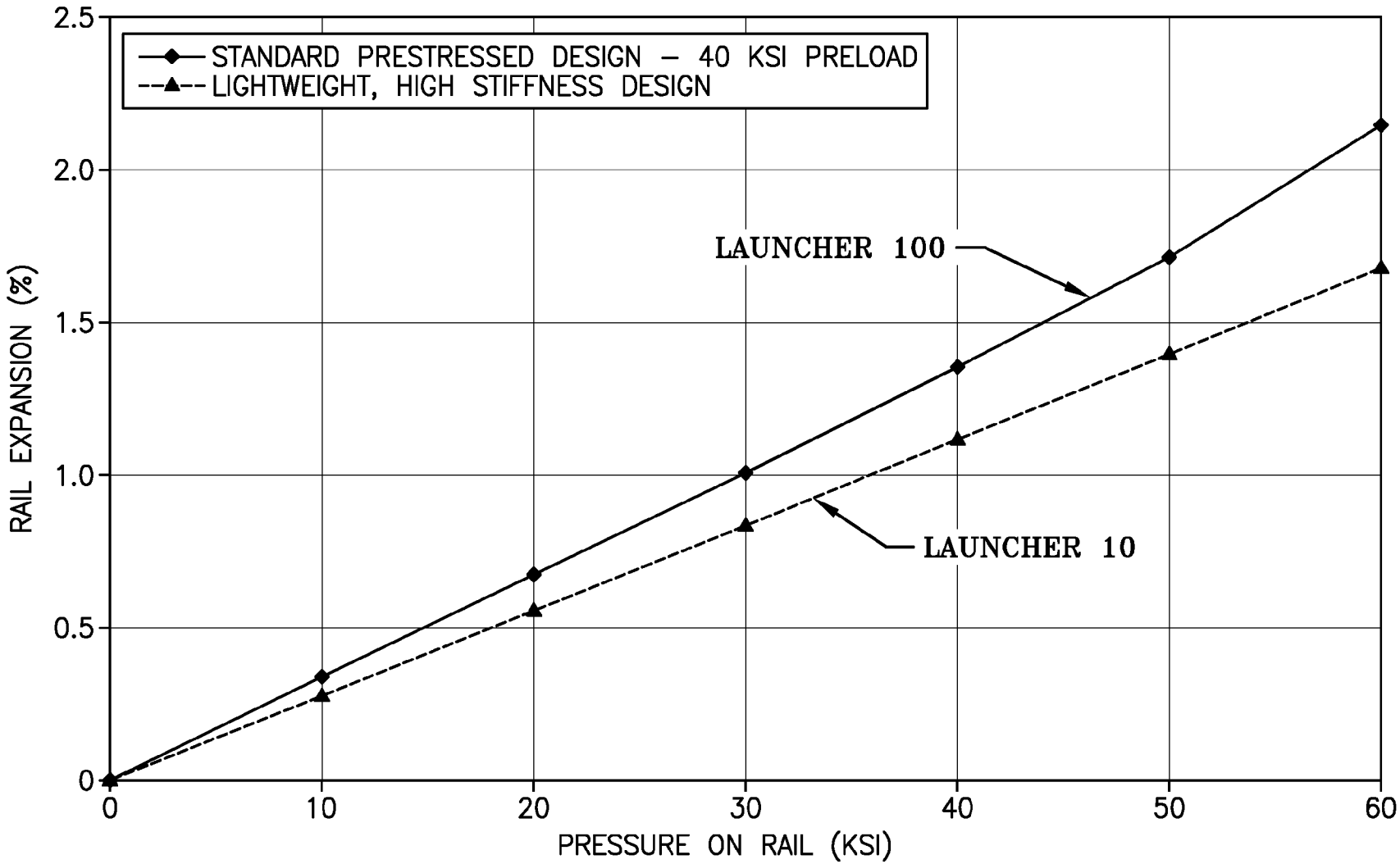

FIGS. 4 and 5 graphically compare rail expansion of prior launchers to the invention. The launchers were made of the same materials and have the same bore geometry. In FIG. 4, both launchers 10, 100 have a one half inch composite jacket. Launcher 100 has a 30 ksi preload and launcher 10 has no preload. In FIG. 5, both launchers 10, 100 have a 0.75 inch jacket. Launcher 100 has a 42 ksi preload and launcher 10 has no preload. In both cases, the launcher 10 produces smaller rail deflections. Launcher 10 is also much lighter in weight than launcher 100 because of smaller rails and insulators, even though the bore sizes are the same.

In launcher 10, the importance of the insulators 16, 18 is reduced to acting as spacers and bore riding surfaces for protecting the jacket 30. In launcher 100, the insulators 116, 118 are required to carry the compression loading of the prestress. This requires that insulators 116, 118 have good compression strength, resulting in thick insulators 116, 118. In launcher 10, the insulators 16, 18 need only be thick enough for assembly purposes and for providing a good bore riding surface. In fact, if the projectile could be constrained from ever touching the insulators 16, 18, then the insulators 16, 18 could be eliminated.

Launcher 10 may use smaller rails 12, 14 than launcher 100. In launcher 100, the rails 112, 114 have to be large enough to interface with the insulators 116, 118. The contact area between the insulators 116, 118 and rails 112, 114 has to be large enough to allow for proper prestress load transfer between the rails 112, 114 and insulators 116, 118. As the insulator size increases to handle the prestress loads, the rail size must also increase. The elimination of the prestress allows for smaller insulators 16, 18 and, thus, smaller rails 12, 14. The rails 12, 14 only need to be slightly larger than the bore 20 to allow for placement of insulators 16, 18 as a spacer.

The aggregate advantages of launcher 10 result in a more compact, lighter weight apparatus. By reducing the size of the insulators 16, 18 and rails 12, 14, the weight of the launcher 10 is reduced. Additionally, the size of the jacket 30 can be reduced if the goal is simply to meet the same rail deflections as a traditional design.

The insulators 16, 18 are primarily used as spacers for assembly purposes and as a riding surface so that the projectile cannot contact the jacket 30 directly. Insulators 16, 18 are not part of the load structure. Any non-electrically conductive material can be used for the insulators 16, 18. The thickness of the insulators 16, 18 is chosen based on ease of manufacture and assembly needs. Additionally, issues of wear may determine how thick the insulators 16, 18 should be. If using a projectile that will not contact the insulators 16, 18 at all, the insulators 16, 18 can be removed after assembly, as they are no longer required to protect the jacket 30.

The rails 12, 14 deliver the electric current to the projectile. Launcher 10 will work with virtually any rail material. The specific material used is a trade off between stiffness, density and electrical properties. As seen in FIG. 2, interior surfaces 22, 24 of the rails 12, 14 are the contact zone between the rails and the projectile (not shown). If insulators 16, 18 are used, the thickness t of the rails 12, 14 should be the contact distance c plus the thickness of the insulators 16, 18. If insulators 16, 18 are not used, then the thickness of the rails 12, 14 should be just enough larger than the contact distance c to ensure that the projectile will not contact the jacket 30.

The curvature of the exterior surfaces 32, 34 of the rails 12, 14 is chosen such that it is either tangent to or becomes flat just before contacting the insulators 16, 18. A small flat surface before the rails 12, 14 contact the insulators 16, 18 ensures that any compression force applied by the jacket 30 is resisted by the rails 12, 14 and not the insulators 16, 18. In FIG. 2, the exterior surfaces 32, 34 of the rails 12, 14 are semicircles that are tangent to the insulators 16, 18 where the rails meet the insulators. The semicircles have a radius of R, as shown in FIG. 2.

The rail/insulator interface is used for assembly purposes. In FIG. 2, a self-fixturing design is shown. However, the details of the rail/insulator interface are not important as long as the insulators 16, 18 keep the rails 12, 14 properly spaced during assembly of the jacket 30. Any rail/insulator interface design that maintains proper spacing during assembly is sufficient. If no insulators are needed, then a removable spacer may be used to keep the rails 12, 14 properly spaced during assembly.

The jacket 30 controls the deflection of rails 12, 14. The jacket 30 is of a sufficient stiffness and strength to maintain the desired rail deflections. High modulus, lightweight composite materials are ideal materials for jacket 30. The modulus of elasticity is preferably at least $20\times10^6$ psi. Also, laminated steel disks may be used if deflection is more of a concern than weight.

An important feature of the jacket 30 is the large interior flat surfaces that conform to and contact the exterior surfaces 36, 38 of the insulators 16, 18. In addition, the jacket 30 must remain in intimate contact with the rails 12, 14. In FIG. 2, contact between the rails 12, 14 and the jacket 30 is between the exterior curved surfaces 32, 34 of the rails 12, 14 and the interior curved surfaces of the jacket 30 that conform to and contact the curved surfaces 32, 34. There is a thin, non-conductive layer (not shown) at the interface between the jacket 30 and the insulators 16, 18 and the rails 12, 14 (i.e., surfaces 36, 38, 32, 34). The thin, non-conductive layer functions as a barrier to prevent an electrical circuit from forming between the rails and the jacket.

Figure 3:
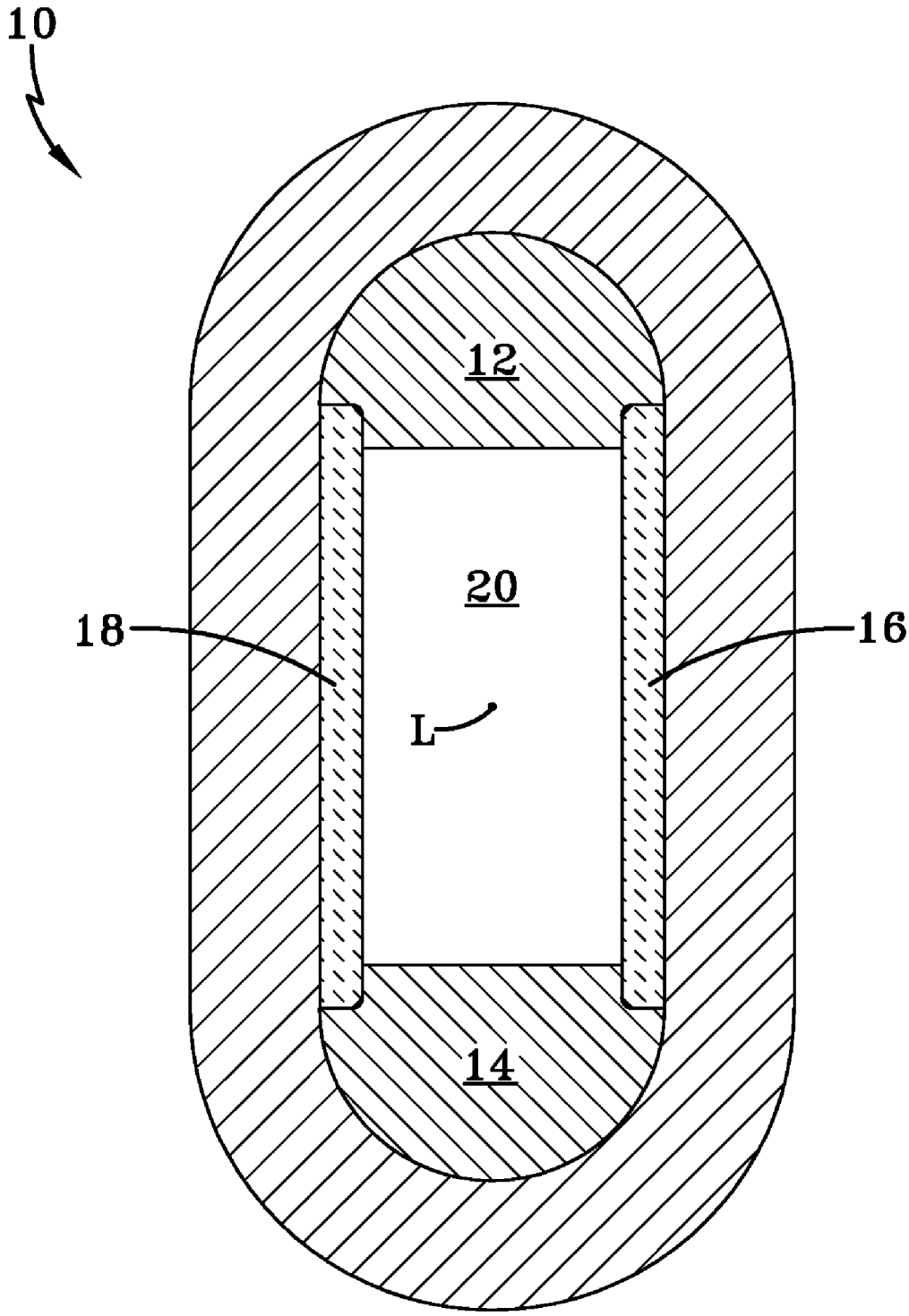
FIG. 3 shows FIG. 2 rotated ninety degrees.

FIG. 3 shows the launcher 10 of FIG. 2 rotated ninety degrees. Launcher 10 may assume a variety of orientations. However, it is the geometric relationship between the jacket 30, rails 12, 14 and insulators 16, 18 that are important to achieve the advantages of the invention. As noted above, the launcher 10 may be used without insulators 16, 18, in proper circumstances.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An electromagnetic launcher having a longitudinal axis, comprising:

a pair of equally sized longitudinally extending rails, each rail having flat interior surfaces thereon and a semicircular exterior surface having a defined radius;

a jacket having an elongated oval cross sectional shape with two ends thereof, said jacket extending around the full semi-circular exterior surface of each rail to enclose one rail within each end of said jacket, without prestress of the jacket caused thereby, and;

two parallel longitudinally extending flat shaped insulators disposed between the rails resting upon flat interior surfaces of said rails and without prestress of the jacket, wherein exterior surfaces of said insulators are substantially flat and rest wholly within said jacket without prestress of the jacket, wherein portions of the interior surface of the jacket that mate with said insulators are flat, and wherein the insulators have a substantially rectangular cross-section, and wherein such disposition between the rails leaves a central open rectangular shaped bore bounded by flat interior surfaces of the rails and flat interior surfaces of the insulators, and;

further wherein the maximum distance (d) between the exterior surfaces of the insulators, measured along an axis that is normal to the exterior surfaces of the insulators, is equal to or less than the maximum thickness (t) of the rails.

2. The launcher of claim 1 wherein a modulus of elasticity of the jacket is at least $30\times10^6$ psi.

3. The launcher of claim 1 wherein the jacket comprises a composite material.

4. The launcher of claim 1 wherein the jacket comprises laminated steel discs.

* * * * *